US008708599B2

(12) United States Patent
Steffen

(10) Patent No.: US 8,708,599 B2
(45) Date of Patent: Apr. 29, 2014

(54) SOIL COMPACTING DEVICE HAVING AN AIR-COOLED BATTERY

(75) Inventor: Michael Steffen, Munich (DE)

(73) Assignee: Wacker Neuson Produktion GmbH & Co. KG, Munich (DE)

( * ) Notice: Subject to any disclaimer, the term of this patent is extended or adjusted under 35 U.S.C. 154(b) by 0 days.

(21) Appl. No.: 13/996,277

(22) PCT Filed: Sep. 22, 2011

(86) PCT No.: PCT/EP2011/004753
§ 371 (c)(1),
(2), (4) Date: Jun. 20, 2013

(87) PCT Pub. No.: WO2012/084074
PCT Pub. Date: Jun. 28, 2012

(65) Prior Publication Data
US 2013/0279980 A1 Oct. 24, 2013

(30) Foreign Application Priority Data
Dec. 22, 2010 (DE) ..... 10 2010 055 632

(51) Int. Cl.
*E01C 19/34* (2006.01)
*E02D 3/068* (2006.01)

(52) U.S. Cl.
CPC ..... *E01C 19/34* (2013.01); *E02D 3/068* (2013.01)
USPC ..... 404/133.1; 404/133.05

(58) Field of Classification Search
CPC ..... E01C 19/34; E02D 3/068
USPC ..... 404/133.05–133.2
See application file for complete search history.

(56) References Cited

U.S. PATENT DOCUMENTS

| | | | | |
|---|---|---|---|---|
| 7,682,102 | B1 * | 3/2010 | Burke et al. | 404/133.1 |
| 2008/0247824 | A1 | 10/2008 | Steffen | |
| 2013/0004237 | A1 * | 1/2013 | Krings et al. | 404/75 |
| 2013/0251452 | A1 * | 9/2013 | Steffen | 404/133.05 |

FOREIGN PATENT DOCUMENTS

| | | | |
|---|---|---|---|
| DE | 299 20 177 | U1 | 1/2000 |
| DE | 10 2007 006 209 | A1 | 2/2007 |
| DE | 10 2009 004 442 | A1 | 1/2009 |
| DE | 20 2010 009 261 | U1 | 6/2010 |
| EP | 1 196 309 | B1 | 7/1999 |
| EP | 1 267 001 | A1 | 6/2001 |

* cited by examiner

*Primary Examiner* — Raymond W Addie
(74) *Attorney, Agent, or Firm* — Boyle Fredrickson, S.C.

(57) ABSTRACT

A soil compacting device has an upper body and a lower body which is coupled to the upper body by a spring device and which has a soil contact element. Furthermore, a drive generates is provided for generating an operating motion of the soil contact element, and an energy store is provided for storing electrical energy. A cooling air flow, which is guided through a cooling air flow guide along the energy store, can be created by an air conveying device.

14 Claims, 2 Drawing Sheets

SOIL COMPACTING DEVICE HAVING AN AIR-COOLED BATTERY

BACKGROUND OF THE INVENTION

1. Field of the Invention

The invention relates to a ground compaction device and to a method for operating an energy store in a ground compaction device. The invention can be used for working devices for ground compaction, such as, for example, tampers, vibration plates or rollers.

2. Discussion of the Related Art

Primed compaction machines are typically driven by combustion engines and/or electric motors. While combustion engines allow a largely independent operation of the ground compaction machine by supplying the energy source in a tank on the machine, it is possible by using electric motors to avoid environmental pollution and a strain on an operator operating the ground compaction machine. In this case, the electric motor is generally supplied via an external connection to the power supply network. Smaller ground compaction machines, which are frequently operated by DC motors, can also be fed by electrical energy from an energy store, such as, for example, an accumulator.

During operation of ground compaction machines with high power requirements by an energy store, there may result a heating of the energy store and in so doing the maximum possible operating temperature of the energy store may possibly be exceeded. For example, a high power consumption and output results in a natural heating of the energy store. Furthermore, the energy store can be additionally heated by a heating of the environment, for example by an operational heat of the mechanical system.

The heating of the energy store can have various disadvantageous consequences. Thus, as a result of the heating, an efficiency of the energy store can lower during the output and consumption of power. Furthermore, the energy store can be permanently damaged by the high operating temperature. Moreover, it is possible that, with the maximum temperature being exceeded, the energy store is destroyed and thus unusable. Furthermore, in the event of the maximum permissible operating temperature being exceeded, it is also possible for an operator of the ground compaction device to be harmed. Possible dangers can take the form of a fire or explosion risk of the overheated energy store. A risk of severe burns and/or poisoning can also arise upon contact with chemicals of a damaged energy store.

A further disadvantage is the high costs which have to be taken into consideration due to an impairment or damage to the energy store during its replacement.

SUMMARY OF THE INVENTION

The object on which the invention is based is to specify a ground compaction device which allows an emission-free or emission-reduced operation with simultaneously a high degree of security for the operator and the components of the ground compaction device.

In accordance with an aspect of the invention, a ground compaction device comprises an upper mass and a lower mass coupled to the upper mass by a spring device. On the lower mass can be arranged a ground contact element, such as, for example, a tamping foot or a ground contact plate. Furthermore, there can be provided a drive which is intended for producing a working movement of the ground contact element and which can, for example, set the lower mass relative to the upper mass into a periodic relative movement.

As a result, the ground contact element can be set into a vibration and/or tamping movement which, during an operation of the ground compaction device for example on a soil, can be used to compact the particles of the soil.

The ground compaction device can have an energy store for storing electrical energy. The electrical energy can be provided for feeding the drive, for feeding an electronic controller of the ground compaction device and/or for any other purpose. The energy store can have an electrical, rechargeable battery, such as, for example, an accumulator with electrochemical cells. The use of a lithium-ion accumulator (Li-Ion type) is possible, for example.

The selection of the accumulator can be made with a view to an energy density, i.e. to the storable energy with respect to the weight. Furthermore, the heat development dependent on the type of accumulator during the charging and discharging of the accumulator can be taken into consideration. This has the effect that expanded or output energy is lost and can, as already described, lead to permanent damage and/or destruction of the accumulator and to damage in the surroundings of the accumulator.

An air conveying device for producing a cooling air flow can be provided in the ground compaction device. The air conveying device can have, for example, a fan with a blower which, by rotating a fan wheel (propeller), sucks in air from the surroundings of the ground compaction device. Furthermore, the air conveying device can also have a bellows and/or an air supply chamber which can be filled with air and which, for example, can be expandable or compressible by means of one or more oscillation devices coupled to a boundary of the air supply chamber. The oscillation devices can be set in oscillation, for example, by the drive and expand the air supply chamber cyclically in an alternating manner by their respective mass, with the result that ambient air can be sucked in, and compress the air supply chamber, with the result that the cooling air flow can be produced from the sucked-in ambient air. For example, at least one of the Oscillation devices can be coupled to the lower or the upper mass and be set in oscillation thereby. Also possible is an expansion or compression of the air supply chamber by the oscillating upper or lower mass itself. Further mechanisms for sucking in ambient air or combinations of the stated mechanisms are also conceivable.

Furthermore, a cooling air flow guide for guiding (conducting) the cooling air flow produced by the air conveying device can be provided. The cooling air flow guide can be formed, for example, by a duct, a line, a hose, a tube and/or a largely closed-off space through which the cooling airflow is conveyed. It can be formed in one piece or be composed of a plurality of, for example, parallel and or sequentially arranged segments or portions. The cooling air flow guide or individual segments thereof can be structurally integrated into other components of the ground compaction device, for example into a housing or a handlebar. Furthermore, the cooling air flow guide can be designed in such a way that damage due to shaking and vibrations in an operating mode is prevented. It is possible to design the cooling, air flow guide or individual segments as a movable and/or expandable hose, for example with walls folded inside one another in the manner of a bellows.

The cooling air flow can be guided along the energy store by means of the cooling air flow guide. For example, the cooling air flow can be guided along a surface of the energy store. This can be achieved, for example, in that the cooling air flow freely flows through an accumulator housing in which the energy store is arranged.

By means of the cooling air flow, an operator heat and/or natural heat can be removed from the energy store, with the result that this heat is cooled. The operating temperature of the energy store must be lowered and can be kept within a permissible operating temperature.

In one embodiment, the cooling air flow guide can guide the cooling air flow along the drive. As a result, an operating or natural heat can also be removed from the drive and the drive can be cooled. In this case, the drive can be cooled by the same cooling air flow as the energy store. It is therefore possible to achieve a cooling of the energy store and of the drive with only one common air flow. Furthermore, it is possible to achieve a cooling of both components with only one air conveying device producing the cooling air flow. This allows a cost-effective design of the cooling air flow guide and of the air conveying device with low requirements on a required installation space.

For example, the energy store can be arranged in spatial proximity to the drive such that common cooling of both components with a single cooling air flow can be achieved simply. Thus, for example, it is possible to arrange the drive and the energy store in a common housing part. In the case of such an arrangement, by routing the cooling air flow from the energy store to the drive, it can be largely prevented that an operating heat of the drive heats the energy store.

Alternatively, it is possible to arrange the energy store and the drive at a greater spatial distance apart, for example at remote positions on the soil compaction device. The cooling air flow can then be guided, for example, through the hose piece from the energy store to the drive. As a result, on the one hand, the energy store can be effectively cooled with fresh ambient air without being additionally heated by the drive, and, on the other hand, a sufficient cooling of the drive with the same cooling air flow can be achieved.

In a variant, the drive can have an electric motor which can be fed by the electrical energy provided by the energy store. Alternatively or in addition, it is also possible for the electric motor to be able to be fed by an external electrical energy source.

Alternatively or in addition, the drive can have a combustion engine by means of which a working movement of the ground contact element can likewise be produced. If both the electric motor and the combustion engine are provided, the working movement can be generated optionally jointly or alternatively by the combustion engine and/or the electric motor.

In this variant, the cooling air flow guide can guide the cooling air flow along the combustion engine. By virtue of such a design, an effective cooling of the energy store, the electric motor and/or the combustion engine can be achieved. For example, the cooling air flow guide can guide the cooling air flow from a suction point to the energy store, from the energy store to the electric motor and/or to the combustion engine.

A cooling of electric motor and combustion engine can be achieved in parallel by a branching of the cooling air flow or in series by guiding the cooling air flow along the motor/engine and then along the engine/motor. For example, during operation of only the motor or engine, the cooling air flow can be guided only along the latter. This can be achieved, for example, by a suitable arrangement of valves or by a suitable arrangement of the air conveying device. The cooling of the electrical energy store and of the drive used with only one air conveying device allows a cost-effective production of the ground compaction device.

In a further embodiment, a controller for electronically controlling the operation of the ground compaction can be provided. The controller makes it possible, for example, to achieve an operation of the drive, the electric motor, the combustion engine and/or further operationally relevant components, such as, for example, a clutch or gearbox of the ground compaction device. Furthermore, the controller can also control an operation of the air conveying device and/or a charging or discharging of the energy store.

In the embodiment, the cooling air flow can also be guided along the controller by the cooling air flow guide. This allows an effective cooling of the electronic controller, the energy store and further, heat-producing components, such as the drive, the electric motor, the combustion engine and/or the mechanically moving components, with only one cooling air flow. In this embodiment, too, it is possible to produce the cooling airflow by means of only one air conveying, device.

In one embodiment, a further cooling air flow guide for guiding a further cooling air flow can be provided. By means of the further cooling air flow guide, the further cooling air flow can be guided along the drive, the controller and/or the combustion engine.

By means of the further cooling air flow guide, the cooling air flow can be split, for example, and be guided at least partially in parallel through the ground compaction device. For example, the further cooling air flow guide can branch after a common portion of the cooling air flow guide. The cooling air flow can thus be divided among a plurality of heat-generating components to be cooled in parallel. Furthermore, it is possible, depending on the cooling requirement, to make available for the heat-generating components a cooling air flow of greater or lesser intensity. For example, in a first section, the energy store can be cooled with the full cooling air flow, but the cooling air flow can be branched in another further section, with the result that the electric motor is cooled with a stronger partial cooling air flow and the controller is cooled with a weaker partial cooling air flow.

Moreover, it is possible for the cooling air flow and the further cooling air flow to be guided separately from the beginning. For example, air for the cooling air flow and the further cooling air flow can be taken in at a plurality of suction openings and be guided separately along a plurality of heat-generating components. This allows an effective cooling with in each case fresh ambient air and a design of the ground compaction device with a plurality of short cooling air flow guides.

In one embodiment, the further cooling air flow can be produced by the air conveying device and/or by a further air conveying device.

During production of the cooling air flow and the further cooling air flow by the air conveying device, the air conveying device can be arranged, for example, in a suction region, wherein the further cooling air flow is branched from the sucked-in cooling air flow in a fear section. Moreover, it is possible that the cooling air flow and the further cooling air flow each have their own suction port, wherein the cooling air flow and the further cooling air flow are combined in a rear section in which the air conveying device can be arranged.

If the cooling air flow is produced by the further air conveying device, both cooling air flows can be guided separately from one another, that is to say without combining or branching. However, it is also possible to operate the air conveying device, the further air conveying device and, if appropriate, additional air conveying devices in a ventilation system in which the cooling air flow and the further cooling air flow can be branched and/or combined again. This makes it possible, as required, for all the portions of the ventilation system to be cooled, for example by switching on or off individual air conveying devices. As a result, it is possible to react flexibly to a starting-up or switching off of individual heat-producing components and to remove the respective operating heat therefrom.

In a further embodiment, the air conveying device and/or the further air conveying device can be coupled to a motor shaft of the drive and/or an engine shaft of the combustion engine. For example, it is possible to arrange the fan wheel of the air conveying device and/or of the further air conveying device on or at the respective motor/engine shaft. A separate drive for the air conveying device is not required in such an arrangement. Moreover, it can be ensured that the air conveying device or the air conveying devices are switched on as required during an operation of the respective motor, with the result that the respective motor is adequately cooled.

In a further embodiment, the air conveying device and/or the further air conveying device can be controlled as a function of an operating temperature or one of the heat-producing components, i.e. the energy store, the drive, the combustion engine and or the controller. For example, an operating temperature of the respective components can be detected and the operation of the respective air conveying device can be actuated as a function of a predetermined temperature threshold being exceeded. A corresponding control or regulation can be performed, for example, by the controller.

In a variant, it is possible to arrange the air conveying device in surroundings of the energy store and to control it as a function of an operating temperature of the energy store. For example, the air conveying device can be arranged in a housing portion enclosing the energy store or in an accumulator housing. By means of a measuring and control device, the operation of the air conveying device can be controlled as a function of the temperature measured in the surroundings of the energy store, and the operating temperature of the energy store can thus be regulated, for example, according to a specification of the manufacturer.

In a further embodiment, an insulating device can be provided for protecting the energy store from heat which is emitted by the remaining heat-producing components of the ground compaction device. As a result of the insulating device, a transmission of the operating heat of the electric motor, the combustion engine and/or the controller and of natural heat (for example frictional heat) of the mechanical system to the energy store can be reduced. In cooperation with the cooling air flow, it is possible as a result to achieve an effective cooling of the energy store.

In a variant, the insulating device can comprise an air-filled intermediate space between the energy store and the remaining heat-producing components of the ground compaction device. The air-filled intermediate space can be achieved, for example, by means of a remote, spatially separate arrangement of the energy store from the remaining heat-producing components of the ground compaction device. The remote arrangement means that air can circulate between the energy store and the remaining heat-producing components and insulate a heat transfer. Alternatively or in addition, the insulating device can be achieved by suitable insulating materials, such as, for example, mineral or organic fibers or foams.

In a further embodiment, the energy store can be mechanically decoupled from the upper mass and/or the lower mass by a damping device. For example, the damping device can comprise a spring device which damps vibrations and oscillations in an operating mode of the ground compaction device. As a result, the energy store can be decoupled from vibrations on the upper and lower mass and be protected from mechanical damage. Given a suitable choice of material, the damping device can additionally have a heat-insulating action and thus, in addition to the mechanical protection, also provide a thermal protection of the energy store. In this case, the damping device and insulating device can be integrated.

In a further embodiment, a guide device decoupled from the upper mass by the damping device can be provided for guiding the ground compaction device by the operator. The guide device can comprise, for example, a guide frame, a handlebar and/or a drawbar on which the operator can hold or guide the ground compaction device. In this embodiment, the energy store can be coupled with the guide device.

By means of such an arrangement of the energy store, the latter is protected in the working mode of the ground compaction device from mechanical oscillations and from an introduction of heat from the remaining heat-producing components. In conjunction with the cooling air flow, an effective cooling of the energy store can be achieved. Moreover, in this arrangement, the mass of the guide device relative to the upper and lower mass is increased. This can result in vibration damping on the guide system and reduce the hand/arm vibration of the operator. From the viewpoint of the operator, a smooth operation of the ground compaction device is thus increased.

In a method for operating an energy store in a ground compaction device, a cooling air flow is produced by an air conveying device and guided along an energy store. Here, as already described, the ground compaction device can comprise an upper mass, a lower mass which is coupled to the upper mass by a spring device and which has a ground contact element, and a drive. The drive can set the ground contact element in an operating movement. Furthermore, a cooling air flow guide for guiding the cooling air flow along the energy store can be provided in the ground compaction device.

The method can furthermore comprise the measuring of an operating temperature of a heat-producing component of the ground compaction device and the controlling of an air conveying device as a function of the measured operating temperature. The method can furthermore comprise the coupling of a fan wheel of the air conveying device with a motor shaft of the drive, of an electric motor and/or of a combustion engine as a function of the measured operating temperature. The cooling air flow produced by the air conveying device can here be guided along the drive, the electric motor and/or the combustion engine.

This and further features of the invention will be explained in more detail below by way of examples with the aid of the appended figures, in which:

DETAILED DESCRIPTION

Figure 1:
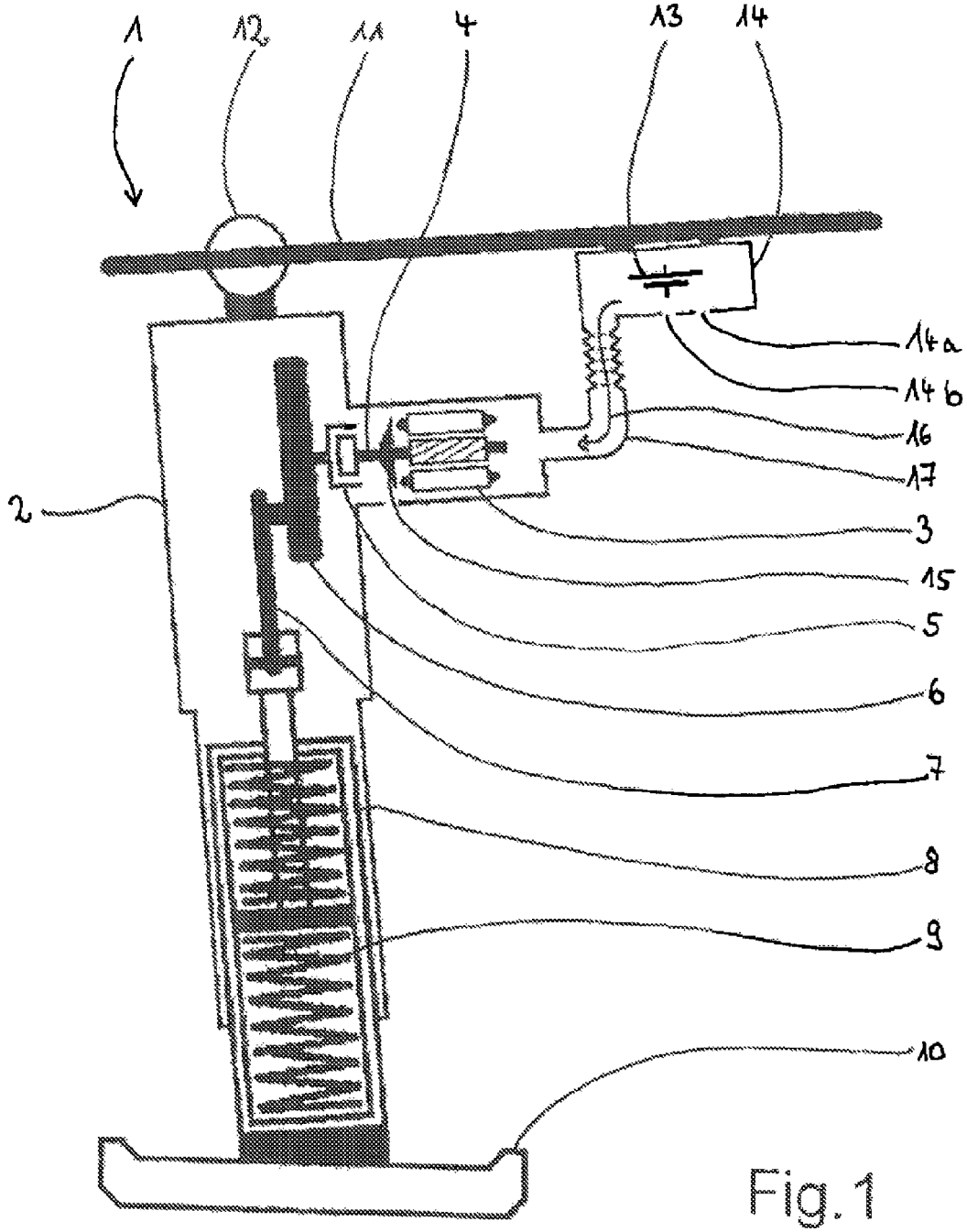
FIG. 1 schematically shows a ground compaction device with an electric motor and an energy store, wherein a cooling airflow is guided along the energy store and the electric motor.

FIG. 1 is a lateral sectional view showing a tamper 1 which serves as a ground compaction device and in which an electric motor 3 as drive of the tamper 1 is provided in a housing 2. The electric motor 3 makes it possible to set in rotation a motor shaft 4 which is connected via a clutch 5 to a crank drive 6. Via a connecting rod 7, the crank drive 6 can set in vibration a spring assembly 9 arranged in a foot body 8. As a result, the foot body 8, together with a tamping foot 10 which is arranged thereon and which is formed as ground contact element, can be set in an oscillating upward and downward movement. The foot body 8, the spring assembly 9 and the tamping foot 10 here form a lower mass which can be set by the drive in a vibrating relative movement with respect to an upper mass formed by the remaining aforementioned components.

In order for an operator (not shown) to guide the tamper 1, a handlebar 11 with an interposed damping device 12 is provided on the housing 2.

The tamper 1 has an energy store 13 on the handlebar 11. The energy store can have a rechargeable battery or an accumulator with electrochemical cells. The energy store 13 is arranged in an accumulator housing 14 in which it is also possible to provide a controller or regulator (not shown) and one or more suction openings 14*a*, 14*b*.

Arranged on the motor shaft 4 is an air conveying device in the form of a fan 15 which can be set in rotation, for example in the manner of a propeller, during a rotation of the motor shaft 4. Other designs of the air conveying device, for example in the manner of a bellows or with an air supply chamber which can be expanded and compressed by oscillating masses, are, as already explained, likewise possible. By means of the air conveying device, or the fan 15, air surrounding the electric motor 3 can be blown in the direction of the crank drive 6 and escape from the housing 2, for example through venting openings (not shown). This results in a structure by means of which air from the surroundings of the tamper 1 is sucked into the accumulator housing 14, for example through the suction openings 14*a*, 14*b*. The sucked-in air forms a cooling air flow 16 which flows through the accumulator housing 14 and in so doing is guided along the energy store 13. As a result, an operating heat of the energy store 13 can be dissipated. The cooling air flow 16 is then guided through a cooling air flow line 17 into the housing 2 and there along the electric motor 3, with the result that an operating heat of the electric motor 3 can be dissipated.

The suction openings 14*a*, 14*b*, the accumulator housing 14, the cooling air flow line 17 and a part of the housing 2 enclosing the electric motor 3 thus form a cooling air flow guide which makes it possible to guide the cooling air flow 16 along the energy store 13, the controller (not shown) and the electric motor 3 and to effectively cool these components.

The arrangement of the energy store 13 on the handlebar 11 means that the energy store 13 is protected from an operating heat of the remaining heat-generating components. This is achieved by the physical spacing and by the ambient air situated between the energy store and the heat-generating components.

Furthermore, the energy store 13 arranged on the handlebar 11 is decoupled from the upper and lower mass of the tamper 1 by the ambient device 12. A transmission of vibrations and oscillations by working movement of the tamper 1 to the energy store 13 is therefore damped by the damping device 12. As a result, the energy store 13 can be protected from mechanical damage.

Furthermore, the energy store 13 and the accumulator housing 14 increase a mass of a guide device formed by the handlebar 11 and the components arranged thereon. An introduction of oscillations and vibrations into the guide device during the working operation of the tamper 1 is thus further damped. This allows a comfortable guiding of the tamper 1 by an operator and protects the operator through a reduced introduction of vibrations to his hands and arms.

Figure 2:
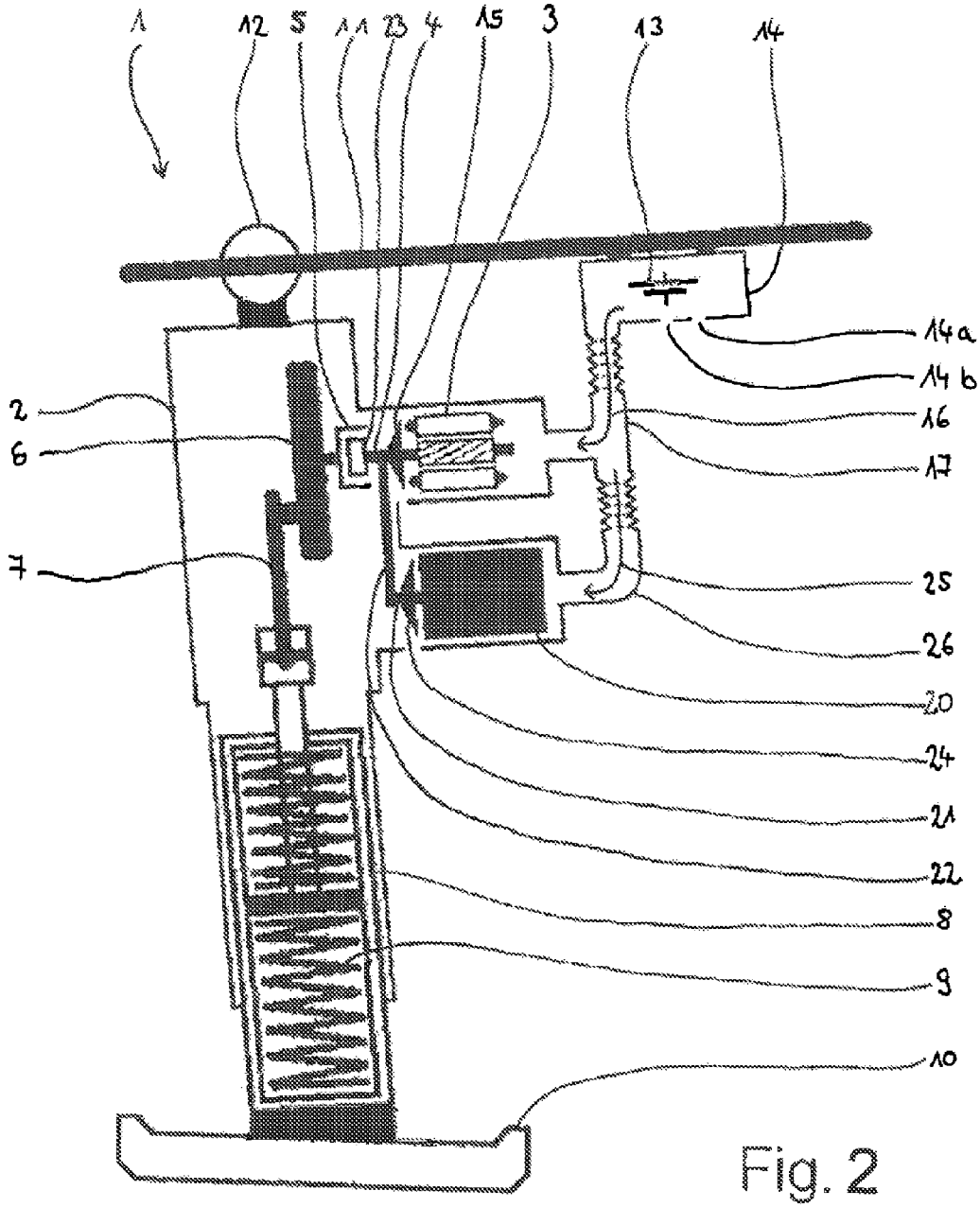
FIG. 2 schematically shows a ground compaction device with an electric motor, a combustion engine and an energy store, wherein a cooling air flow is guided along the energy store and along the respectively operated motor/engine.

FIG. 2 shows a further embodiment of the tamper 1 in a lateral sectional view. In addition to the components shown in FIG. 1, a combustion engine 20 with a further engine shaft 21 is provided. The combustion engine 20 can of course also be arranged at another point on the tamper 1.

A torque of the further engine shaft 21 can be transmitted with the aid of a transmission device 22, for example a belt drive, to a drive side 23 of the clutch 5. The motor shaft 4 of the electric motor 3 can be decoupled from the torque. Furthermore, it is possible for the torque to be transmitted at least partially to the motor shaft 4 of the electric motor 3 and to use this for example as a generator for charging the energy store 13. In this way, a hybrid system is produced.

A further fan 24 is shown by way of example, but with no limitation, as a further air conveying device on the further engine shaft 21 of the combustion engine 20, this fan, in the above-described manner, producing a suction and hence a further cooling air flow 25 from the suction openings 14*a*, 14*b* in the accumulator housing 14 along the energy store 13 and the possibly present controller. The further cooling air flow 25 can be guided to the combustion engine 20 through the cooling air flow line 17 and through a further cooling air flow line 26 which branches from the cooling air flow line 17. Consequently, during an operation of the combustion engine 20, the energy store 13, the controller and the combustion engine 20 can be effectively cooled by the further cooling air flow 25.

If the torque of the further engine shaft 21 is transmitted to the motor shaft 4 and the electric motor 3 is operated as a generator, the fan 15 can thus also be set in operation. As a result, in the manner described above, the cooling air flow 16 is additionally produced and the electric motor 3 operated as generator is cooled as required.

The invention claimed is:

1. A ground compaction device comprising:

an upper mass and a lower mass which is coupled to the upper mass by a spring device and which has a ground contact element;

a drive that produces a working movement of the ground contact element (10);

an energy store that stores electrical energy;

an air conveying device that produces a cooling air flow; and a cooling air flow guide that guides the cooling air flow along the energy store.

2. The ground compaction device as claimed in claim 1, wherein the cooling air flow guide guides the cooling air flow along the drive.

3. The ground compaction device according to claim 1, wherein:

the drive comprises an electric motor and a combustion engine which can be operated either jointly or alternatively; and wherein the cooling air flow guide guides the cooling air flow along at least one of the electric motor and the combustion engine.

4. The ground compaction device as claimed in claim 1, further comprising a controller that controls an operation of the ground compaction device; and wherein the cooling air flow guide guides the cooling air flow along the controller.

5. The ground compaction device as claimed in claim 4, further comprising a further cooling air flow guide that guides a further cooling air flow; and wherein the further cooling air flow guide guides the further cooling air flow along at least one of the electric motor, the combustion engine the controller.

6. The ground compaction device as claimed in claim 1, wherein the further cooling air flow is produced by at least one of the air conveying device and a further air conveying device.

7. The ground compaction device as claimed in claim 6, wherein at least one of the air conveying device and the further air conveying device is coupled to at least one of a motor/engine shaft of the electric motor and the combustion engine.

8. The ground compaction device as claimed in claim 6, wherein at least one of the air conveying device and the further air conveying device can be controlled based on an operating temperature of at least one of the energy store, the drive, the electric motor, the combustion engine, and a controller that controls an operation of the round compaction device.

9. The ground compaction device as claimed in claim 1, wherein the air conveying device is arranged in the surroundings of the energy store and is controlled based on an operating temperature of the energy store.

10. The ground compaction device as claimed in claim 1, further comprising an insulating device for protecting the energy store from heat which is emitted by heat-generating components of the ground compaction device.

11. The ground compaction device as claimed in claim 10, wherein the insulating device comprises an air-filled intermediate space between the energy store and the heat-generating components of the ground compaction device.

12. The ground compaction device as claimed in claim 1, wherein the energy store is mechanically decoupled from at least one of the upper mass and the lower mass by a damping device.

13. The ground compaction device as claimed in claim 12, further comprising a guide device that is decoupled from the upper mass by the damping device and that can be used by an operator to guide the ground compaction device; and wherein the energy store is coupled to the guide device.

14. A method for operating an energy store in a ground compaction device, wherein the ground compaction device comprises an upper mass, a lower mass which is coupled to the upper mass by a spring device and which has a ground contact element, and a drive that produces as working movement of the ground contact element can be set in a working movement, the method comprising:

producing a cooling air flow using an air conveying device; and guiding the cooling air flow along the energy store.

* * * * *

UNITED STATES PATENT AND TRADEMARK OFFICE

CERTIFICATE OF CORRECTION

PATENT NO. : 8,708,599 B2
APPLICATION NO. : 13/996277
DATED : April 29, 2014
INVENTOR(S) : Steffen It is certified that error appears in the above-identified patent and that said Letters Patent is hereby corrected as shown below:

IN THE CLAIMS:

| | |
|---|---|
| CLAIM 5, Line 7<br>Col. 9, Line 7 | Add "and" between "engine" and "the" |
| CLAIM 8, Line 4<br>Col. 9, Line 20 | Replace "store" with "stored" |
| CLAIM 8, Line 6<br>Col. 9, Line 22 | Replace "round" with "ground" |

Signed and Sealed this
First Day of July, 2014

Michelle K. Lee

Michelle K. Lee
*Deputy Director of the United States Patent and Trademark Office*